US007570239B2

(12) United States Patent
Cheon et al.

(10) Patent No.: US 7,570,239 B2
(45) Date of Patent: Aug. 4, 2009

(54) METHOD OF COMPENSATING IMAGE SIGNALS AND DISPLAY DEVICE EMPLOYING THE SAME

(75) Inventors: Man-Bok Cheon, Yongin-si (KR); Po-Yun Park, Seoul (KR)

(73) Assignee: Samsung Electronics Co., Ltd. (KR)

( * ) Notice: Subject to any disclaimer, the term of this patent is extended or adjusted under 35 U.S.C. 154(b) by 789 days.

(21) Appl. No.: 10/975,953

(22) Filed: Oct. 28, 2004

(65) Prior Publication Data

US 2005/0093803 A1 May 5, 2005

(30) Foreign Application Priority Data

Oct. 31, 2003 (KR) ..... 10-2003-0076650

(51) Int. Cl.
*G09G 3/36* (2006.01)

(52) U.S. Cl. ..... 345/87; 345/98

(58) Field of Classification Search ..... 345/87–100, 345/204; 348/790–794
See application file for complete search history.

(56) References Cited

U.S. PATENT DOCUMENTS 5,446,456 A * 8/1995 Seo ..... 341/118
5,873,830 A * 2/1999 Hossack et al. ..... 600/447
6,750,874 B1 * 6/2004 Kim ..... 345/600
2001/0021220 A1 * 9/2001 Fert et al. ..... 375/240.03

* cited by examiner

*Primary Examiner*—Nitin Patel
(74) *Attorney, Agent, or Firm*—Cantor Colburn LLP

(57) ABSTRACT

An image display device includes a display panel having pixels, and a signal compensate unit for receiving first, second and third image signals externally provided, and for generating a first compensate signal obtained from the first and second image signals. The signal compensate unit generates a second compensate signal obtained from the first compensate signal and the first and third image signals. The image display device also includes a data driver for receiving the second compensate signal from the signal compensate unit, and for generating data voltages corresponding to the second compensate signal to the pixels of the display panel. A method for compensating image signals includes recognizing first, second and third image signals at three successive frames, obtaining a first compensate signal from the first and second image signals, obtaining a second compensate signal from the first and third image signals and the first compensate signal, and providing the second compensate signal to pixels of a display panel.

31 Claims, 14 Drawing Sheets

METHOD OF COMPENSATING IMAGE SIGNALS AND DISPLAY DEVICE EMPLOYING THE SAME

BACKGROUND OF THE INVENTION

1. Field of the Invention

The present invention relates to a device and method for displaying images, and more particularly, to a method of compensating image signals to improve display quality and a display device employing the method.

2. Description of the Related Art

Devices displaying images using liquid crystal generally have a liquid crystal layer with dielectric anisotropy between substrates of a display panel assembly. The liquid crystal display (LCD) devices display images by controlling the amount of light transmitting the liquid crystal layer. Such control of the amount of light is performed by controlling the intensity of electric field applied to the liquid crystal layer.

The liquid crystal display devices are flat panel display type and have thin film transistors as switching elements in pixels of the display panel assembly. Such TFT-LCD devices are widely used in image display systems and apparatus. A TFT-LCD device generally includes pixels, gate lines, and data lines. The TFT-LCD device also includes a gate driver, a data driver, and a timing controller. The gate driver applies certain voltages to the gate lines for turning on the switching element, and the data driver applies data voltages to the data lines for displaying desired images.

The conventional TFT-LCD devices have a relatively slow response rate of the liquid crystal and thus have some drawbacks in displaying moving images due to the slow response rate. Since the liquid crystal has a slow response rate in the conventional TFT-LCD devices, it takes time for the voltage level of a liquid crystal capacitance to reach a target voltage level, which is a voltage level necessary to gain a desired luminance. The time for reaching a target voltage level varies depending on a previous voltage level of the liquid crystal capacitance. In case that the difference between the previous voltage level and the target voltage level of the liquid crystal capacitance is excessively large, the voltage level of the liquid crystal capacitance is not able to reach the target voltage level during the switching elements are turned on.

There have been developments to improve the response rate of liquid crystal. One of the developments is a dynamic capacitance compensation (DCC) system, which utilizes the theory that the speed of charging electricity increases as a voltage level of the liquid crystal capacitance becomes larger. In the DCC system, a data voltage level (here, assuming that a common voltage level is zero) applied to a corresponding pixel is set to be higher than the target voltage level, so that the time for a voltage level of the liquid crystal capacitance to reach the target voltage level is reduced.

In the conventional DCC system, a signal to compensate image signals to be displayed is generated based on previous and present image signals. In the LCD devices employing the conventional DCC system, however, there have been problems such that the response rate of liquid crystal is relatively low in some gray scale changes (e.g., from black to white).

Therefore, a need exists for a system which compensates image signals while improving the response rate of liquid crystal. Further, it will be advantageous to provide an LCD device employing such a system of compensating image signals.

SUMMARY OF THE INVENTION

The above mentioned and other drawbacks and deficiencies of the prior art are overcome or alleviated by a method of compensating image signals and a display device employing the same according to the present invention. In one embodiment, an image display device includes a display panel having pixels, a signal compensate unit that receives first, second and third image signals externally provided, and generates a first compensate signal obtained from the first and second image signals, the signal compensate unit generating a second compensate signal obtained from the first compensate signal and the first and third image signals, and a data driver that receives the second compensate signal from the signal compensate unit, which generates data voltages corresponding to the second compensate signal to the pixels of the display panel. The first, second and third image signals are image signals at three successive frames.

The signal compensate unit includes a frame memory that generates the first and second image signals, and receives and stores the third image signal, a first compensator that receives the first and second image signals from the frame memory and generates the first compensate signal, and a second compensator that receives the first compensate signal from the first compensator, the first image signal from the from the frame memory, and the third image signal externally provided, and generates the second compensate signal.

In another embodiment, a method for compensating image signals in a display device, includes recognizing first, second and third image signals at three successive frames, obtaining a first compensate signal from the first and second image signals, obtaining a second compensate signal from the first and third image signals and the first compensate signal, and providing the second compensate signal to pixels of a display panel. The step of obtaining the second compensate signal includes comparing the first image signal, the first compensate signal and the third image signal with first, second and third predetermined values, respectively, and determining the second compensate signal based on a result of the comparing.

These and other objects, features and advantages of the present invention will become apparent from the following detailed description of illustrative embodiments thereof, which is to be read in connection with the accompanying drawings.

BRIEF DESCRIPTION OF THE DRAWINGS

This disclosure will present in detail the following description of exemplary embodiments with reference to the following figures wherein:

FIGS. 10A to 10D are images at different frames displayed when a different test pattern is applied;

DETAILED DESCRIPTION OF THE INVENTION

Detailed illustrative embodiments of the present invention are disclosed herein. However, specific structural and functional details disclosed herein are merely representative for purposes of describing exemplary embodiments of the present invention.

Figure 1:
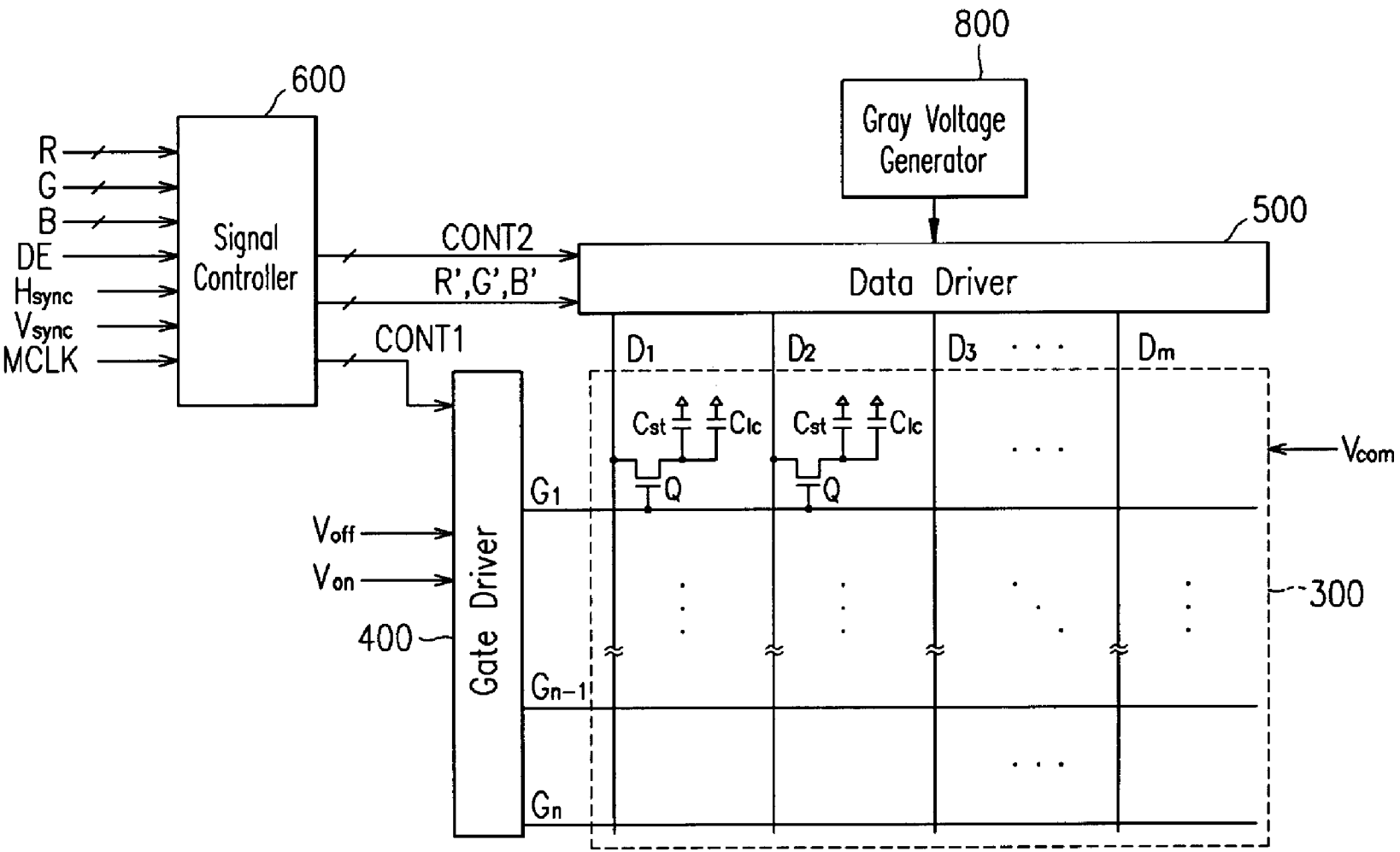
FIG. 1 is a block diagram illustrating a display device according to an exemplary embodiment of the present invention.

Referring to FIG. 1, provided is a block diagram illustrating a display device according to an exemplary embodiment of the present invention. In this embodiment, the display device in FIG. 1 is a liquid crystal display device which includes a liquid crystal panel assembly 300, a gate driver 400, a data driver 500, a gray voltage generator 800, and a signal controller 600 that controls the above components.

Figure 2:
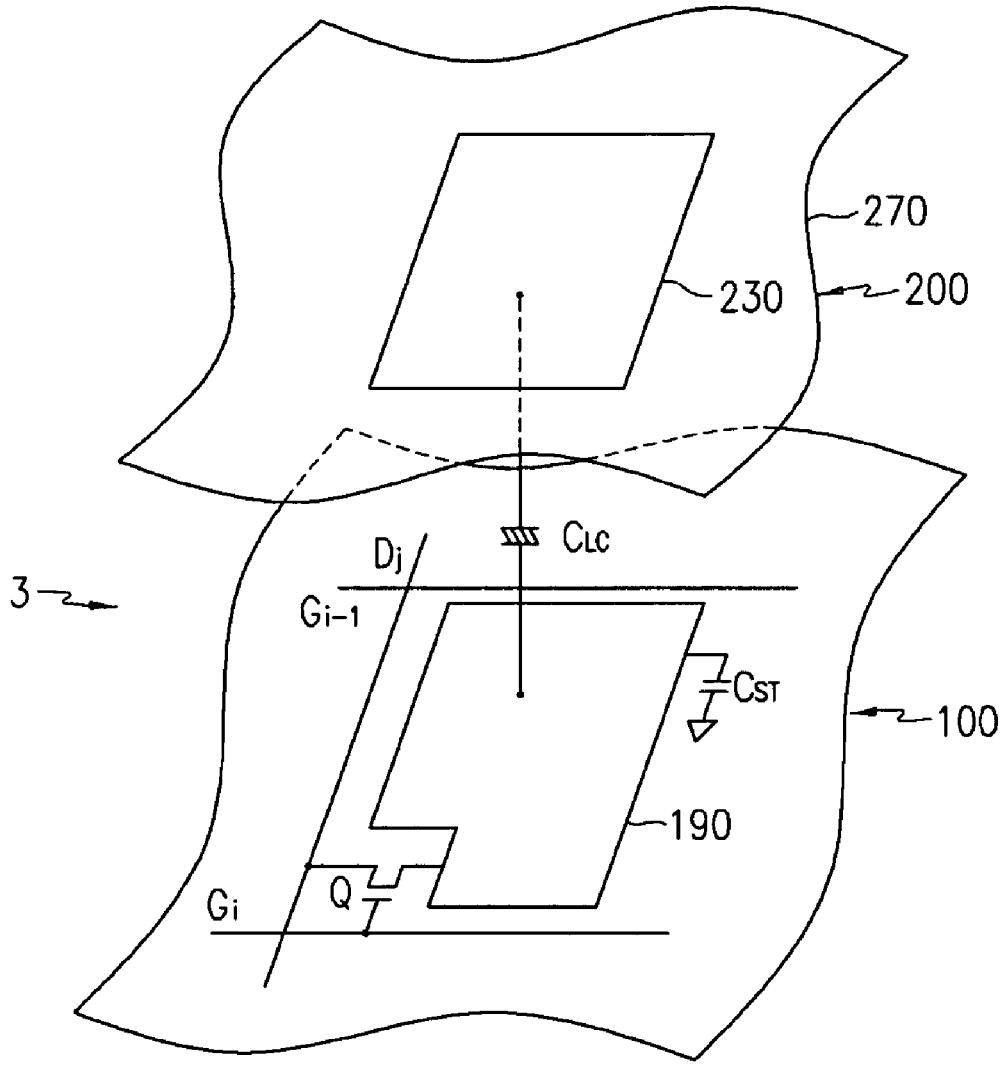
FIG. 2 is an equivalent circuit of a pixel of the liquid crystal panel assembly in FIG. 1.

The liquid crystal panel assembly 300 includes multiple pixels that are arranged in a matrix form and connected with multiple signal lines $G_1$-$G_n$ and $D_1$-$D_m$. FIG. 2 is an equivalent circuit of a pixel of the liquid crystal panel assembly 300 in FIG. 1. The signal lines include gate lines $G_1$-$G_n$ for transmitting gate signals (or scan signals) and data lines $D_1$-$D_m$ for transmitting data signals. The gate lines $G_1$-$G_n$ are substantially parallel with each other and arranged in a row direction, and the data lines $D_1$-$D_m$ are substantially parallel with each other and arranged in a column direction.

Each pixel includes a switch element Q connected to the signal lines $G_1$-$G_n$ and $D_1$-$D_m$ and a liquid crystal capacitor $C_{LC}$ connected to the switch element Q. Each pixel may also include a storage capacitor $C_{ST}$ connected to the switch element Q. The switch elements Q are, for example, thin film transistors provided on a lower panel 100 and each include three terminals which are a control terminal connected to one of the gate lines $G_1$-$G_n$, an input terminal connected to one of the data lines $D_1$-$D_m$, and an output terminal connected to the liquid crystal capacitor $C_{LC}$. In case that a pixel has the storage capacitor $C_{ST}$, the output terminal of the respective switch elements Q is connected to both the liquid crystal capacitor $C_{LC}$ and the storage capacitor $C_{ST}$.

The liquid crystal capacitor $C_{LC}$ includes the pixel electrode 190 on the lower panel 100, a common electrode 270 on a upper panel 200, and a liquid crystal layer 3 as a dielectric layer between the electrodes 190 and 270. The pixel electrode 190 is connected to the switch element Q, and the common electrode 270 covers the entire surface of the upper panel 100 and is supplied with a common voltage Vcom. In another embodiment, both the pixel electrode 190 and the common electrode 270 may be provided on the lower panel 100 and have a bar or stripe shape.

The storage capacitor $C_{ST}$ is an auxiliary capacitor for the liquid crystal capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage Vcom. In a different embodiment, the storage capacitor $C_{ST}$ may include the pixel electrode 190 and an adjacent gate line called a previous gate line, which overlaps the pixel electrode 190 via an insulator.

For color display, each pixel uniquely represents one of three primary colors such as red, green and blue colors or sequentially represents the three primary colors in time, thereby obtaining a desired color. FIG. 2 shows an example that each pixel includes a color filter 230 representing one of the three primary colors in an area of the upper panel 200 facing its pixel electrode 190. In a different embodiment, the color filter 230 may be provided on or under the pixel electrode 190 on the lower panel 100. A polarizer (not shown) polarizing the light is attached on outer side of at least one of the two panels 100 and 200.

The gray voltage generator 800 generates two sets of gray voltages related to transmittance of the pixels. The gray voltages in one set have a positive polarity with respect to the common voltage Vcom, while those in the other set have a negative polarity with respect to the common voltage Vcom.

The gate driver 400 is disposed in association with the liquid crystal panel assembly 300 and is connected to the gate lines $G_1$-$G_n$. The gate driver 400 synthesizes a gate-on voltage Von and a gate-off voltage Voff from a driving voltage generator (not shown) to generate gate signals for application to the gate lines $G_1$-$G_n$.

The data driver 500 is connected to the data lines $D_1$-$D_m$ of the liquid crystal panel assembly 300 and applies data voltages selected from the gray voltages supplied from the gray voltage generator 800 to the data lines $D_1$-$D_m$.

The IC chips of the gate driver 400 and/or the data driver 500 may be mounted on a tape carrier package that is connected to the liquid crystal panel assembly 300, or directly mounted on a glass panel by means of chip-on-glass mounting method. In another embodiment, an IC chip having the same function as the gate and data drivers 400 and 500 may be mounted on the liquid crystal panel assembly 300.

The signal controller 600 receives image signals R, G, B and control and clock signals DE, Hsync, Vsync, MCLK externally provided and generates control signals to the gate and data drivers 400 and 500.

Now, operation of the liquid crystal display device in response to the control signals will be described in detail. The signal controller 600 is supplied with RGB image signals R, G, B and input control signals controlling the display thereof such as a vertical synchronization signal Vsync, a horizontal synchronization signal Hsync, a main clock MCLK, and a data enable signal DE, from an external graphic controller (not shown). After generating gate control signals CONT1 and data control signals CONT2 and processing the image signals R, G, B suitable for operation of the liquid crystal panel assembly 300 on the basis of the input control signals, the signal controller 600 provides the gate control signals CONT1 for the gate driver 400, the processed image signals R', G', B' and the data control signals CONT2 for the data driver 500.

The gate control signals CONT1 include a vertical synchronization start signal STV for informing start of a frame, a gate clock signal CPV for controlling an output time of the gate-on voltage Von, and an output enable signal OE for defining width of the gate-on voltage Von. The data control signals CONT2 include a horizontal synchronization start signal STH for informing start of a horizontal period, a load signal LOAD or TP for instructing to apply data voltages to the data lines $D_1$-$D_m$, an inversion control signal RVS for reversing polarity of the data voltages (with respect to the common voltage Vcom) and a data clock signal HCLK.

The data driver 500 receives the image data R', G', B' from the signal controller 600 and converts the image data R', G', B' into analogue data voltages selected from the gray voltages supplied from the gray voltage generator 800 in response to the data control signals CONT2 from the signal controller 600.

Responsive to the gate control signals CONT1 from the signals controller 600, the gate driver 400 applies the gate-on voltage Von to the gate lines $G_1$-$G_n$, thereby turning on the switch elements Q connected thereto. The data driver 500 applies the data voltages to the corresponding data lines $D_1$-$D_m$ for a turn-on time of the switch elements Q (which is called "one horizontal period" or "1H" and equals to one period of the horizontal synchronization signal Hsync, the data enable signal DE, and the gate clock signal CPV). Then, the data voltages are sequentially supplied to the corresponding pixels via the turned-on switch elements Q.

Difference between the data voltage and the common voltage Vcom applied to a pixel is expressed as a charged voltage of the LC capacitor $C_{LC}$, i.e., a pixel voltage. The liquid crystal molecules have orientations depending on magnitude of the pixel voltage and the orientations determine the polarization of light passing through the LC capacitor $C_{LC}$. The polarizers convert the light polarization into the light transmittance.

By repeating this procedure, all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that polarity of the data voltages is reversed (which is called "frame inversion"). The inversion control signal RVS may be also controlled such that polarity of the data voltages flowing in a data line in one frame are reversed (which is called "line inversion"), or polarity of the data voltages in one packet are reversed (which is called "dot inversion").

In the signal controller 600, a compensate signal is obtained from a present image signal that is an image signal of the present frame, a previous image signal that is an image signal of the previous frame, and a following image signal that is an image signal of the following frame. By providing the compensate signal, the response rate of liquid crystal is improved so that deterioration of images may be prevented. In the following description, the image signals of the "(n−1)-th" frame, "n-th" frame and "(n+1)-th" frame are named as a previous image signal $S_{n-1}$, a present image signal $S_n$ and a following image signal $S_{n+1}$, respectively.

Figure 3:
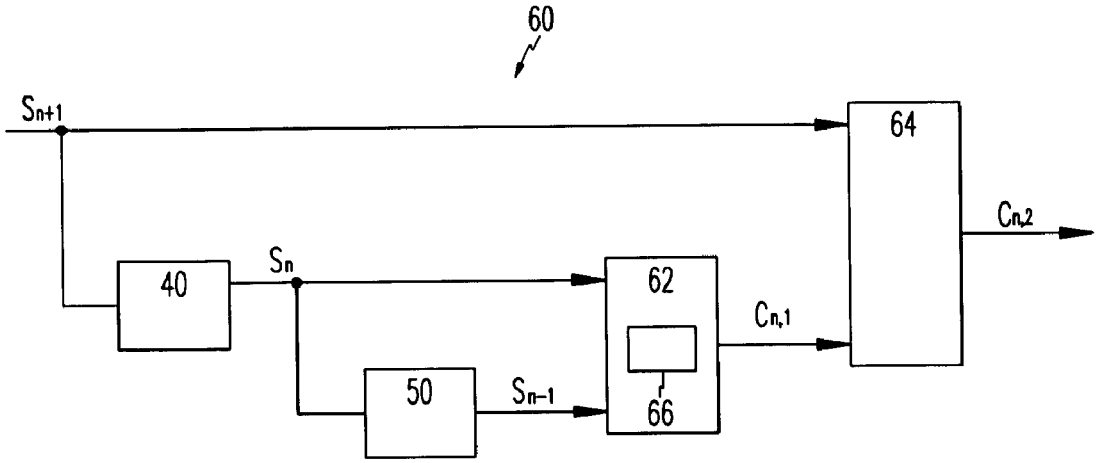
FIG. 3 is a schematic block diagram of a signal compensate unit according to an embodiment of the invention.
Figure 4:
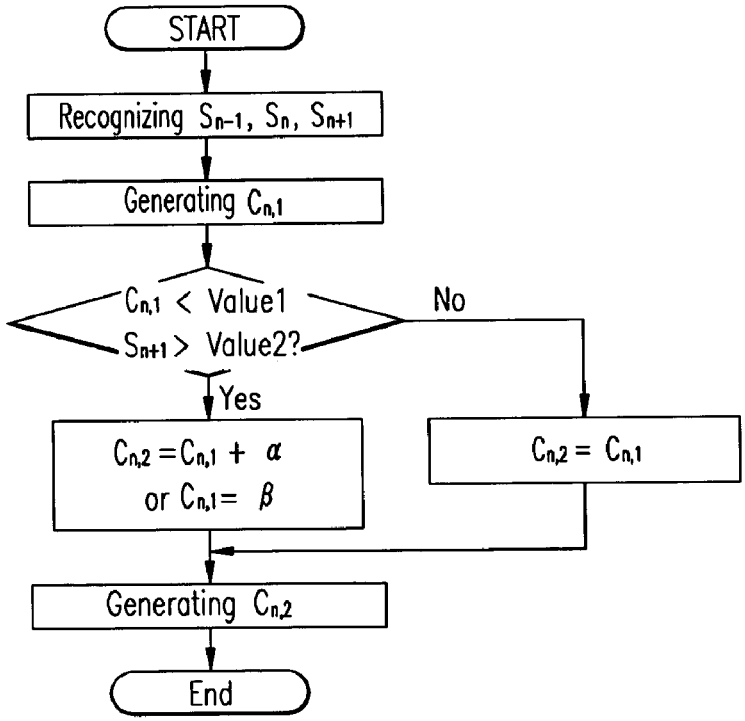
FIG. 4 is a flowchart for describing operation of the signal compensate unit in FIG. 3.

FIG. 3 is a schematic block diagram of a signal compensate unit 60 according to an embodiment of the invention, and FIG. 4 is a flowchart for describing the operation of the signal compensate unit 60 in FIG. 3. The signal compensate unit 60 may be included in the signal controller 600 in FIG. 1, or one or more parts of the signal compensate unit 60 may be included in the signal controller 600. The signal compensate unit 60 may also be provided separate from the signal controller 600. In this embodiment, the signal compensate unit 60 receives first to third image signals at three successive frames.

The signal compensate unit 60 includes a first frame memory 40, a second frame memory 50 receiving the output of the first frame memory 40, a first compensator 62 receiving the outputs of the first and second frame memories 40 and 50, and a second compensator 64 receiving the output of the first compensator 62 and the following image signal $S_{n+1}$.

The first frame memory 40 provides the present image signal $S_n$ to the second frame memory 50 and the first compensator 62. The first frame memory 40 receives the following image signal $S_{n+1}$ from an external component and stores it therein. The second frame memory 50 provides the previous image signal $S_{n-1}$ to the first compensator 62. The second frame memory 50 receives the present image signal $S_n$ from the first frame memory 40 and stores it therein. It is noted that the first frame memory 40 and the second frame memory 50 may be implemented with separate memory devices or a single memory device. In the latter case, the single memory device provides the present image signal $S_n$ and the previous image signal $S_{n-1}$ to the first compensator 62, and receives the following image signal $S_{n+1}$ and stores it therein.

The first compensator 62 receives the present image signal $S_n$ and the previous image signal $S_{n-1}$ from the first frame memory 40 and the second frame memory 50, respectively, and generates a first compensate signal $C_{n,1}$. For example, the first compensate signal $C_{n,1}$ is obtained by compensating the present image signal $S_n$ in consideration of the previous image signal $S_{n-1}$.

The second compensator 64 receives the first compensate signal $C_{n,1}$ from the first compensator 62 and the following image signal $S_{n+1}$ externally provided, and generates a second compensate signal $C_{n,2}$. For example, the second compensate signal $C_{n,2}$ is obtained by compensating the first compensate signal $C_{n,1}$ in consideration of the following image signal $S_{n+1}$. This is described in detail below.

Referring back to FIG. 1, the data driver 500 receives the image data R', G' and B' including the second compensate signal $C_{n,2}$ provided from the signal controller 600 as well as the gray voltages from the gray voltage generator 800. The data driver 500 generates analogue data voltages corresponding to the second compensate signal $C_{n,2}$ to the pixels of the liquid crystal panel assembly 300 via the data lines.

Referring to FIG. 4, the operation of the first and second compensators 62 and 64 will be described in detail. Upon receiving the present image signal $S_n$ and the previous image signal $S_{n-1}$, the first compensator 62 selects compensate data from a look-up table 66, which corresponds to the present and previous image signals. Since the look-up table 66 has multiple elements of compensate data each corresponding to a pair of the present and previous image signals, the first compensator 62 may select compensate data corresponding to a specific pair of present and previous image signals upon receiving and recognizing those signals. It should be noted that the look-up table 66 may be included in the first compensator 62 or provided in a separate component.

The compensate data in the look-up table 66 is determined in accordance with experiments or liquid crystal modes of the display device. In this embodiment, the compensate data in the look-up table 66 is set such that: when the previous image signal $S_{n-1}$ is smaller than the present image signal $S_n$, the first compensator 62 selects compensate data to generate the first compensate signal $C_{n,1}$ larger than the present image signal $S_n$; and when the difference between the previous image signal $S_{n-1}$ and the present image signal $S_n$ is within a certain value, the first compensator 62 selects compensate data to generate the first compensate signal $C_{n,1}$ that is substantially equal to the present image signal $S_n$.

The second compensator 64 compares the first compensate signal $C_{n,1}$ and the following image signal $S_{n+1}$ with predetermined values to generate the second compensate signal $C_{n,2}$. In this embodiment, the second compensator 64 compares the first compensate signal $C_{n,1}$ and the following image signal $S_{n+1}$ with first and second predetermined values Value1 and Value2, respectively. When the first compensate signal $C_{n,1}$ is smaller than the first predetermined value Value1 and the following image signal $S_{n+1}$ is larger than the second predetermined value Value2, the second compensator 64 adds a compensate value $\alpha$ to the first compensate signal $C_{n,1}$ to generate the second compensate signal $C_{n,2}$. The compensate value $\alpha$ is determined by comparing and analyzing the first compensate signal $C_{n,1}$ and the following image signal $S_{n+1}$. For example, the compensate value $\alpha$ is selected from a look-up table that contains multiple compensate values each corresponding to a specific range of the first compensate signal $C_{n,1}$ and the following image signal $S_{n+1}$. The compensate value $\alpha$ may be a constant value. The look-up table of the compensate values may be included in the look-up table 66 of the compensate data or implemented with a separate data storage.

Alternatively, in this case, the second compensator 64 generates a predetermined compensate value $\beta$, which is a constant value, as the second compensate signal $C_{n,2}$. Thus, in this case, the second compensator 64 generates either the constant value $\beta$ or a signal equal to the summation of the first compensate signal $C_{n,1}$ and the compensate value $\alpha$ as the second compensate signal $C_{n,2}$.

When the first compensate signal $C_{n,1}$ is equal to or larger than the first predetermined value Value1 or the following image signal $S_{n+1}$ is equal to or smaller than the second predetermined value Value2, the second compensator 64 generates the second compensate signal $C_{n,2}$ that is substantially equal to the first compensate signal $C_{n,1}$.

Figure 5:
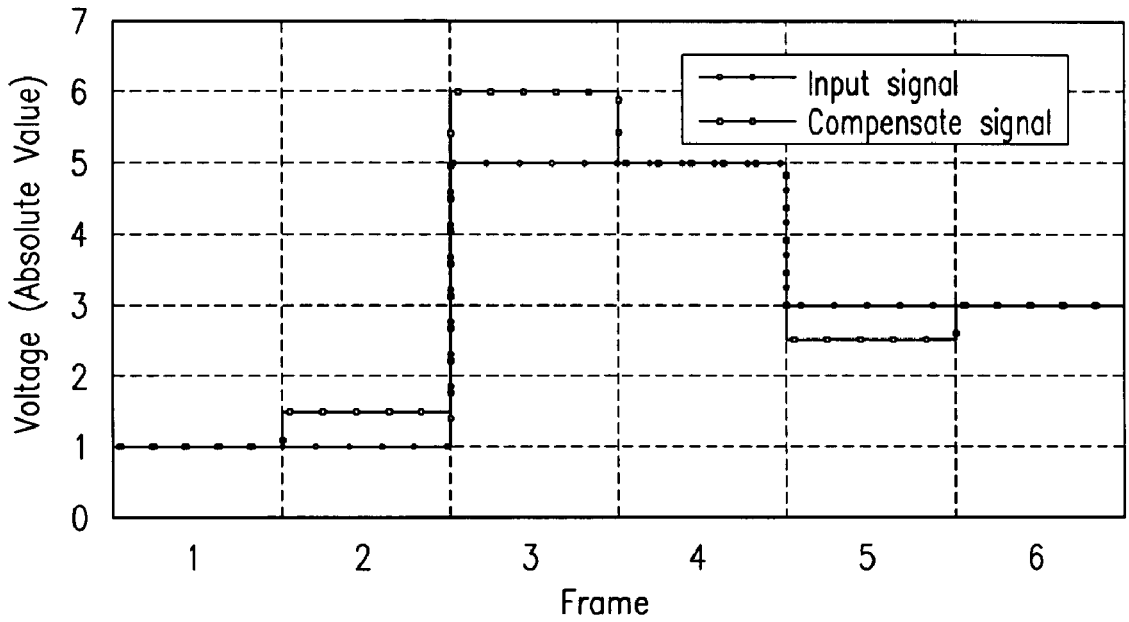
FIG. 5 is a graphical view of signal waveforms of input and output signals of the signal controller in FIG. 3.

FIG. 5 is a graphical view of signal waveforms of input and output signals of the signal compensate unit 60 in FIG. 3. Referring to FIG. 5, the signal compensate unit 60 receives the input signal having different values in different frames and generates the output signal obtained by compensating the input signal. Here, voltages of the input and output signals in FIG. 5 represent absolute values. Thus, the polarity of the signals with a certain voltage value may be either positive or negative.

In this embodiment, the input signal has 1-voltage value in Frames 1 and 2, 5-voltage value in Frames 3 and 4, and 3-voltage value in Frames 5 and 6. At Frame 3, the first compensator 62 receives the voltage values of the input signal of Frames 2 and 3 and generates 6-voltage value output signal as the first compensate signal. At Frame 5, the first compensator 62 receives the voltage values of the input signal of Frames 4 and 5 and generates 2.5-voltage value output signal as the first compensate signal. At Frames 2, 4 and 6, since the voltage value of the input signal at the present frame is the same as that of the previous frame, the first compensator 62 generates an output signal equal to the input signal as the first compensate signal.

For example, assuming that the first and second predetermined values Value1 and Value2 are "1.5" and "4.5", respectively, and the constant value $\beta$ is "1.5", the second compensator 64 generates 1.5-voltage value output signal at Frame 2 and an output signal equal to the first compensate signal at Frames 1 and 3-6 as the compensate signal. Accordingly, the second compensate signal has 1-voltage value at Frame 1, 1.5 voltage-value at Frame 2, 6-voltage value at Frame 3, 5-voltage value at Frame 4, 2.5 voltage-value at Frame 5, and 3-voltage value at Frame 6. By providing such a compensate signal, the display device improves the display quality. For instance, by applying the 1.5-voltage value compensate signal to pixels at Frame 2, the response rate at Frame 3 is improved because the liquid crystal is pre-tilted and the system rapidly approaches the target voltage.

Figure 6:
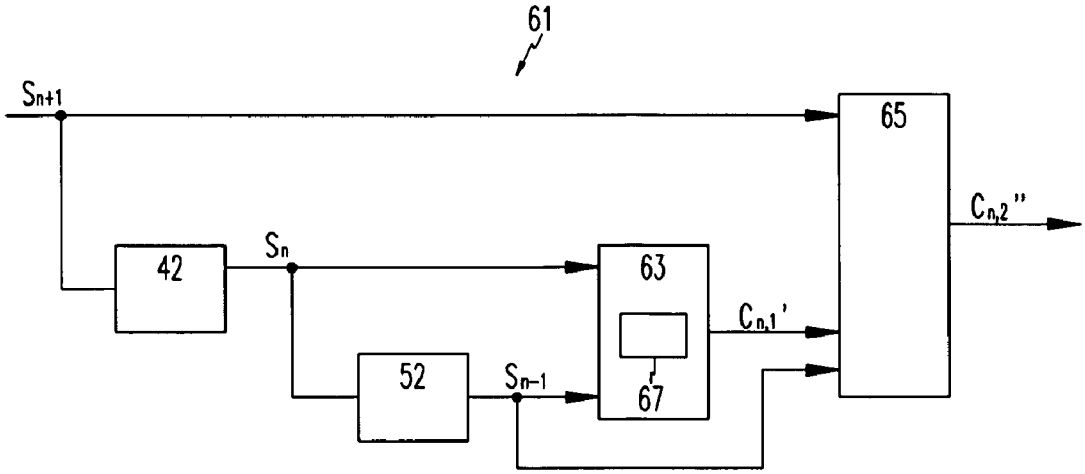
FIG. 6 is a schematic block diagram of a signal compensate unit according to another embodiment of the present invention.
Figure 7:
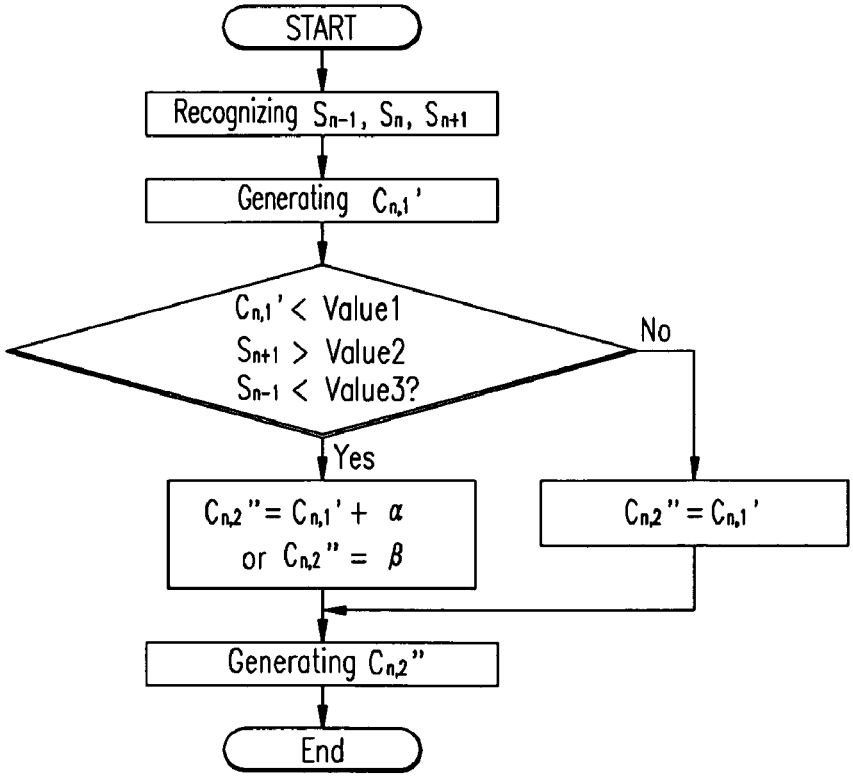
FIG. 7 is a flowchart for describing operation of the signal compensate unit in FIG. 6.

FIG. 6 is a schematic block diagram of a signal compensate unit according to another embodiment of the present invention, and FIG. 7 is a flowchart for describing the operation of the signal compensate unit 61 in FIG. 6. The signal compensate unit 61 may be included in the signal controller 600 in FIG. 1, or one or more parts of the signal compensate unit 61 may be included in the signal controller 600. The signal compensate unit 61 may also be provided separate from the signal controller 600. In this embodiment, the signal compensate unit 61 receives the first to third image signals at three successive frames.

The signal compensate unit 61 includes a first frame memory 42, a second frame memory 52 receiving the output of the first frame memory 42, a first compensator 63 receiving the outputs of the first and second frame memories 42 and 52, and a second compensator 65 receiving the output of the first compensator 63 and the following image signal $S_{n+1}$.

The first frame memory 42 provides the present image signal $S_n$ to the second frame memory 52 and the first compensator 63. The first frame memory 42 receives the following image signal $S_{n+1}$ from an external component and stores it therein. The second frame memory 52 provides the previous image signal $S_{n-1}$ to the first compensator 63. The second frame memory 52 receives the present image signal $S_n$ from the first frame memory 42 and stores it therein. It is noted that the first frame memory 42 and the second frame memory 52 may be implemented with separate memory devices or a single memory device. In the latter case, a single memory device provides the present image signal $S_n$ and the previous image signal $S_{n-1}$ to the first compensator 63, and receives the following image signal $S_{n+1}$ and stores it therein.

The first compensator 63 receives the present image signal $S_n$ and the previous image signal $S_{n-1}$ from the first frame memory 42 and the second frame memory 52, respectively, and generates a first compensate signal $C_{n,1}'$. For example, the first compensate signal $C_{n,1}'$ is obtained by compensating the present image signal $S_n$ in consideration of the previous image signal $S_{n-1}$.

The second compensator 65 receives the first compensate signal $C_{n,1}'$ from the first compensator 63, the previous image signal $S_{n-1}$ from the second frame memory 52, and the following image signal $S_{n+1}$ externally provided, and generates a second compensate signal $C_{n,2}''$. For example, the second compensate signal $C_{n,2}''$ is obtained by compensating the first compensate signal $C_{n,1}'$ in consideration of the previous image signal $S_{n-1}$ and the following image signal $S_{n+1}$. This is described in detail below.

Referring to FIG. 7, the operation of the first and second compensators 63 and 65 will be described in detail. Upon receiving the present image signal $S_n$ and the previous image signal $S_{n-1}$, the first compensator 63 selects compensate data from a look-up table 67, which corresponds to the present and previous image signals. Since the look-up table 67 has multiple elements of compensate data each corresponding to a pair of the present and previous image signals, the first compensator 63 may select compensate data corresponding to a specific pair of present and previous image signals upon receiving and recognizing those signals. It should be noted that the look-up table 67 may be included in the first compensator 63 or provided in a separate component.

The compensate data in the look-up table 67 is determined in accordance with experiments or liquid crystal modes of the display device. In this embodiment, the compensate data in the look-up table 67 is set such that: when the previous image signal $S_{n-1}$ is smaller than the present image signal $S_n$, the first compensator 63 selects compensate data to generate the first compensate signal $C_{n,1}'$ larger than the present image signal $S_n$; and when the difference between the previous image signal $S_{n-1}$ and the present image signal $S_n$ is within a certain value, the first compensator 63 selects compensate data to generate the first compensate signal $C_{n,1}'$ that is substantially equal to the present image signal $S_n$.

The second compensator 65 compares the first compensate signal $C_{n,1}'$, the previous image signal $S_{n-1}$, and the following image signal $S_{n+1}$ with predetermined values to generate the second compensate signal $C_{n,2}''$. In this embodiment, the second compensator 65 compares the first compensate signal $C_{n,1}'$, the following image signal $S_{n+1}$, and the previous image signal $S_{n-1}$ with first, second and third predetermined values Value1, Value2 and Value3, respectively. When the first compensate signal $C_{n,1}'$ is smaller than the first predetermined value Value1, the following image signal $S_{n+1}$ is larger than the second predetermined value Value2, and the previous image signal $S_{n-1}$ is larger than the third predetermined value Value3, the second compensator 65 adds a compensate value $\alpha$ to the first compensate signal $C_{n,1}'$ to generate the second compensate signal $C_{n,2}''$. The compensate value $\alpha$ is determined by comparing and analyzing the first compensate signal $C_{n,1}'$, the following image signal $S_{n+1}$, and the previous image signal $S_{n-1}$. For example, the compensate value $\alpha$ is selected from a look-up table that contains multiple compensate values each corresponding to a specific range of the first compensate signal $C_{n,1}'$, the following image signal $S_{n+1}$ and the previous image signal $S_{n-1}$. The compensate value $\alpha$ may be a constant value. The look-up table of the compensate values may be included in the look-up table 67 of the compensate data or implemented with a separate data storage.

Alternatively, in this case, the second compensator 65 generates a predetermined compensate value $\beta$, which is a constant value, as the second compensate signal $C_{n,2}''$. Thus, in this case, the second compensator 65 generates either the constant value $\beta$ or a signal equal to the summation of the first compensate signal $C_{n,1}'$ and the compensate value $\alpha$ as the second compensate signal $C_{n,2}''$.

When the first compensate signal $C_{n,1}'$ is equal to or larger than the first predetermined value Value1, the following image signal $S_{n+1}$ is equal to or smaller than the second predetermined value Value2, or the previous image signal $S_{n-1}$ is equal to or larger than the third predetermined value Value3, the second compensator 65 generates the second compensate signal $C_{n,2}''$ that is substantially equal to the first compensate signal $C_{n,1}'$.

Assuming that the signal compensate unit 61 receives the same input signal as shown in FIG. 5 and the first, second and third predetermined values Value1, Value2 and Value3 and the constant value $\beta$ are "1.5", "4.5", "2" and "1.5", respectively, the signal compensate unit 61 generates the same compensate signal as shown in FIG. 5. Thus, the response rate is improved in this embodiment as well by applying the compensate signal to the pixels. This is because the liquid crystal is pre-tilted and the system rapidly approaches the target voltage.

Now, a description of images at different frames displayed using the above embodiments of the present invention follows. It is assumed in this description that the display device displaying images is a normally black liquid crystal display device that displays black when the transmittance is about 0% and white when the transmittance is about 100%.

Referring to FIGS. 8A to 8D, provided are images at different frames displayed by the liquid crystal display device employing the signal compensate unit 60 shown in FIG. 3. FIG. 9 is a graphical view showing transmittance at different frames. In FIG. 9, the transmittance of each frame represents transmittance at the region with a "star" mark in the corresponding image.

Figure 8A:
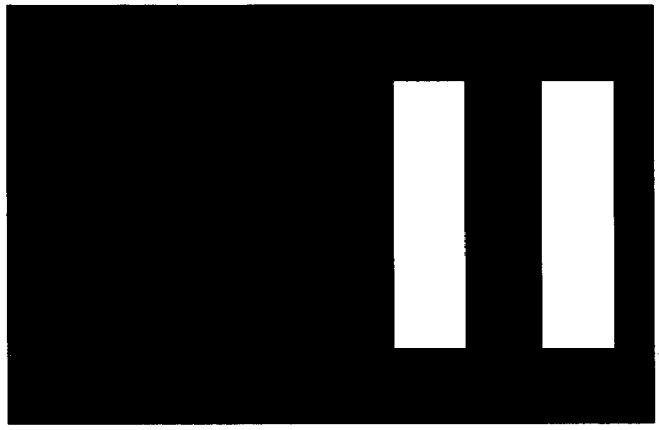
FIGS. 8A to 8D are images at different frames displayed by the liquid crystal display device employing the signal compensate unit in FIG. 3.
Figure 8B:
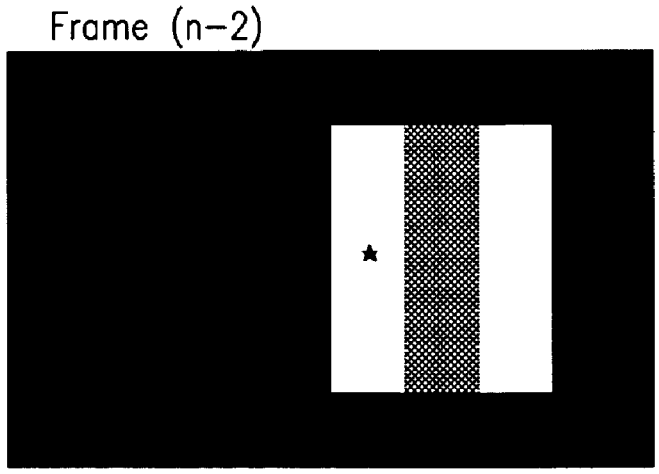
Figure 8C:
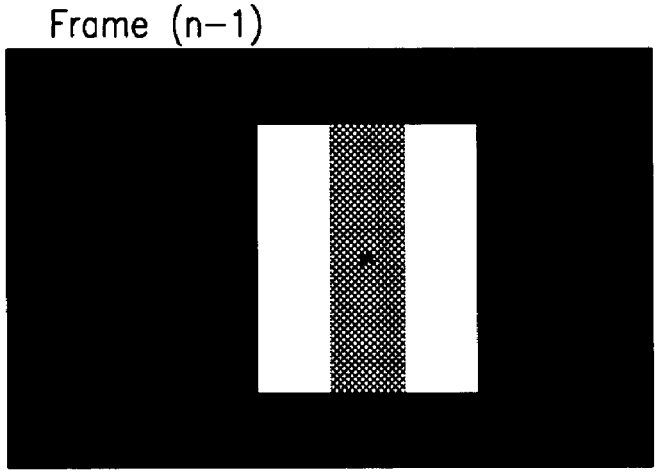
Figure 8D:
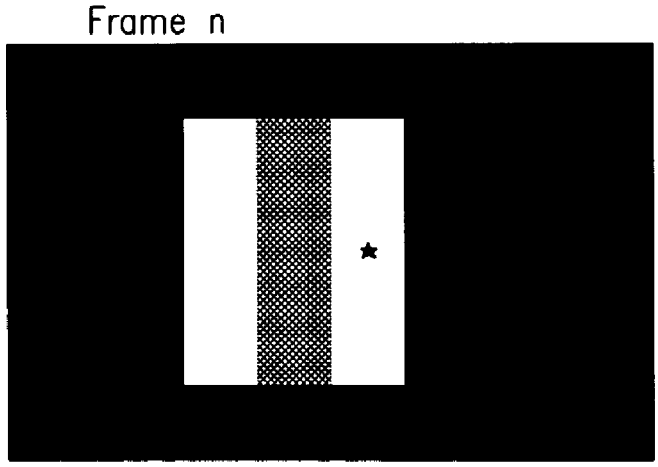
Figure 9:
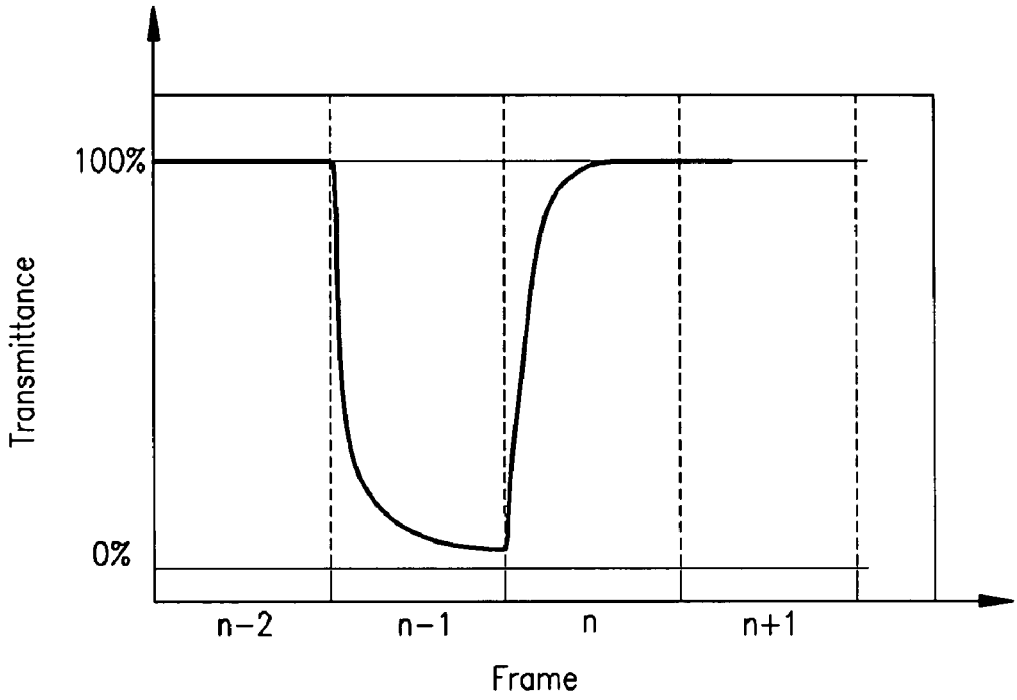
FIG. 9 is a graphical view showing transmittance at different frames shown in FIGS. 8A to 8D.

FIG. 8A is an image of a test pattern, and FIGS. 8B to 8D are images at the (n−2)-th frame, the (n−1)-th frame and the n-th frame, respectively. The test pattern in FIG. 8A has two white rectangles and black background in its image. The two white rectangles are separated from each other at the same distance as the width of each white rectangle. The test pattern moves toward the left-hand or right-hand side such that the two white rectangles move by a distance equal to the width of each white rectangle when the frame changes to the next one.

In this embodiment, FIGS. 8B to 8D show images at different frames where the test pattern moves toward the left-hand side. Also, in the images of FIGS. 8B to 8D, the region with a "star" mark indicates an identical region at different frames. As the test pattern moves toward the left-hand side, the input signal for the region with the "star" mark changes to have values corresponding to white, black and white in sequence. For example, assuming that the transmittance is 0% when the input signal is an 1-voltage signal and 100% when the input signal is a 5-voltage signal, the input signal becomes a 5-voltage signal at the (n−2)-th frame, an 1-voltage signal at the (n−1)-th frame, and a 5-voltage signal at the n-th frame. Upon receiving the input signal, the signal compensate unit generates an 1.5-voltage signal (or pre-tilt voltage signal) at the (n−1)-th frame and a 6-voltage signal (or overshoot voltage signal) at the n-th frame as the compensate signal that is applied to the pixels. The transmittance at the (n−1)-th frame becomes a value corresponding to the pre-tilt voltage, which is larger than 0% as shown in FIG. 9. As a result, the rectangle between the two white rectangles has a predetermined gray scale as shown in FIG. 8C, which is not black as shown in FIG. 8A. In the n-th frame, the transmittance rapidly approaches to 100% owing to the overshoot voltage signal so that the region with the "star" mark becomes white.

In this embodiment, the input signal for the region between the two white rectangles changes in sequence to have values corresponding to white, black and white, and the signal compensate unit generates the compensate signal obtained by compensating the input signal in the above-described manner. As a result, the region between the two white rectangles has a certain gray scale as shown in FIGS. 8B to 8D.

Figure 10A:
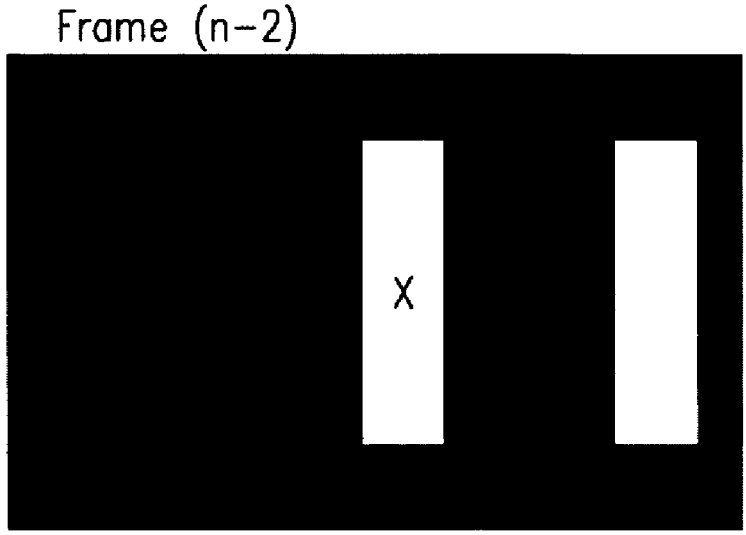
Figure 10C:
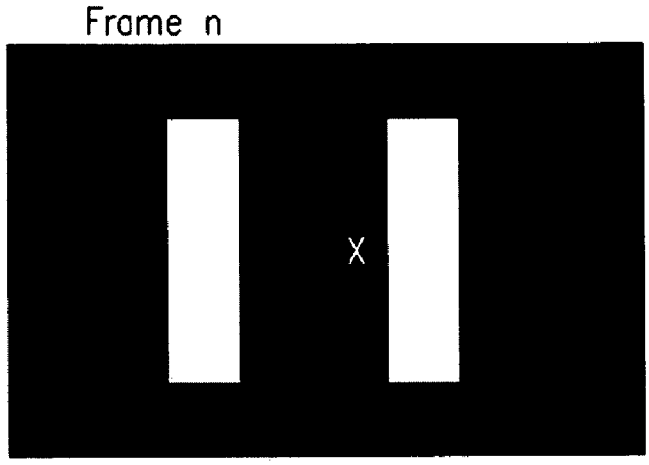
Figure 10D:
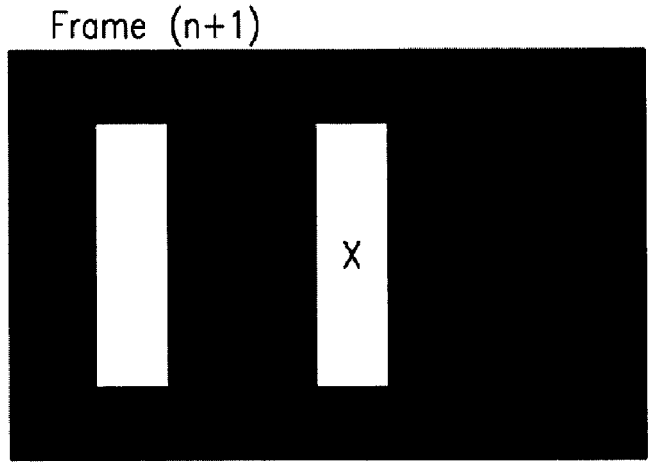
Figure 11:
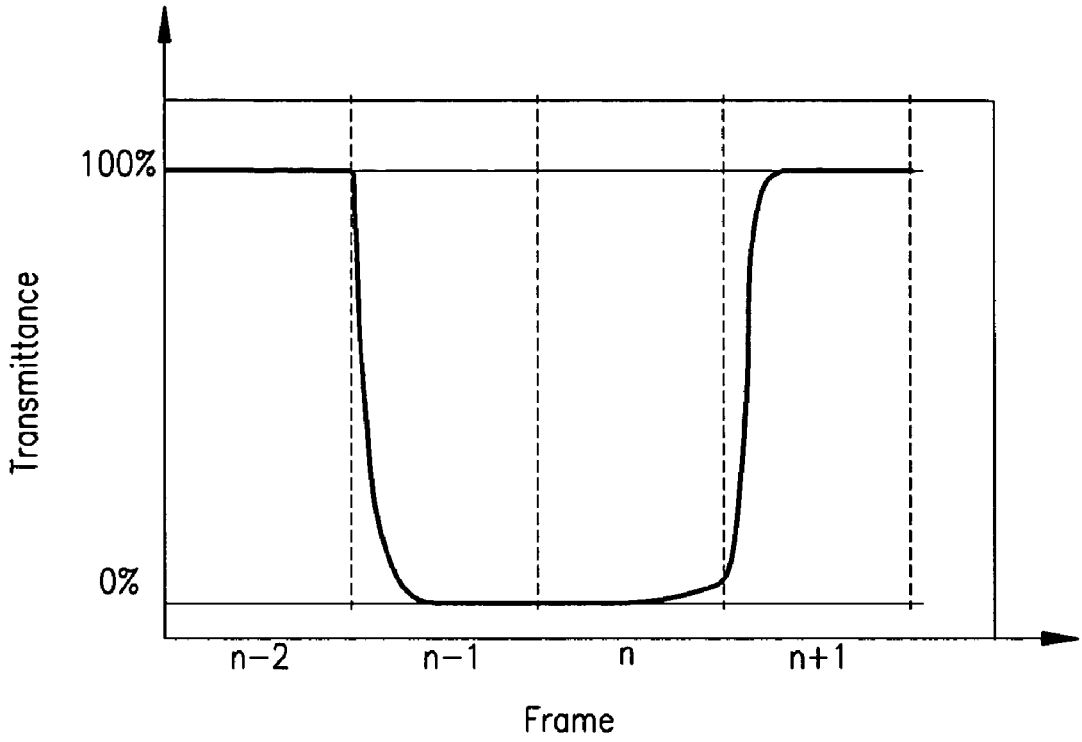
FIG. 11 is a graphical view showing transmittance at different frames shown in FIGS. 10A to 10D.

FIGS. 10A to 10D show images at different frames displayed when a different test pattern is applied. FIG. 11 is a graphical view showing transmittance at different frames. In FIG. 11, the transmittance of each frame represents transmittance at the region with a "x" mark in the corresponding image. In this example, it is assumed that the liquid crystal display device of the present invention employs the signal compensate unit 60 in FIG. 3.

The test pattern of this example has two white rectangles which are separated from each other at a distance twice the width of each white rectangle. The test pattern moves toward the left-hand or right-hand side such that the two white rectangles move by a distance equal to the width of each white rectangle when the frame changes to the next one.

In this embodiment, FIGS. 10A to 10D show images at different frames where the test pattern moves toward the left-hand side. Also, in the images of FIGS. 10A to 10D, the region with the "x" mark indicates an identical region at different frames. As the test pattern moves toward the left-hand side, the input signal for the region with the "x" mark changes to have values corresponding to white, black, black and white in sequence. For example, the input signal becomes a 5-voltage signal at the (n−2)-th frame, an 1-voltage signal at the (n−1)-th and n-th frames, and a 5-voltage signal at the (n+1)-th frame.

Upon receiving the input signal, the signal compensate unit generates an 1-voltage signal at the (n−1)-th frame, an 1.5-voltage signal (or pre-tilt voltage signal) at the n-th frame, and a 6-voltage signal (or overshoot voltage signal) at the (n+1)-th frame as the compensate signal that is applied to the pixels. The transmittance at the (n−1)-th and n-th frames becomes 0% and the transmittance at the (n+1)-th frame becomes 100% as shown in FIG. 11. As a result, the region between the two white rectangles displays black at the (n−1)-th and n-th frames, and the region with the "x" mark displays white at the (n+1)-th frame as shown in FIGS. 10B to 10D.

Figure 12A:
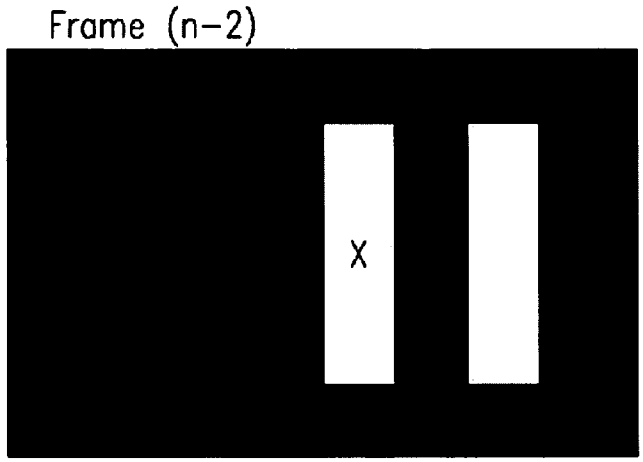
FIGS. 12A to 12C are images at different frames displayed by the liquid crystal display device employing the signal compensate unit in FIG. 6.
Figure 12B:
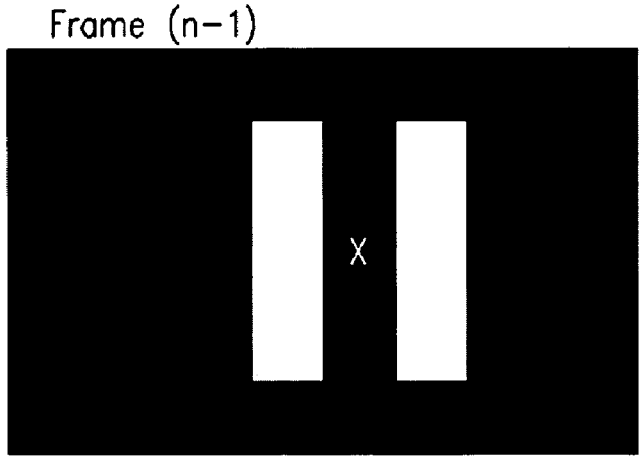
Figure 12C:
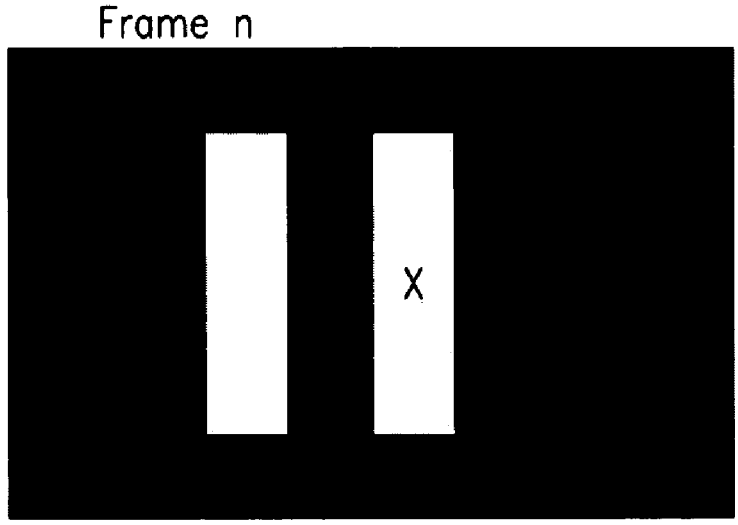
Figure 13:
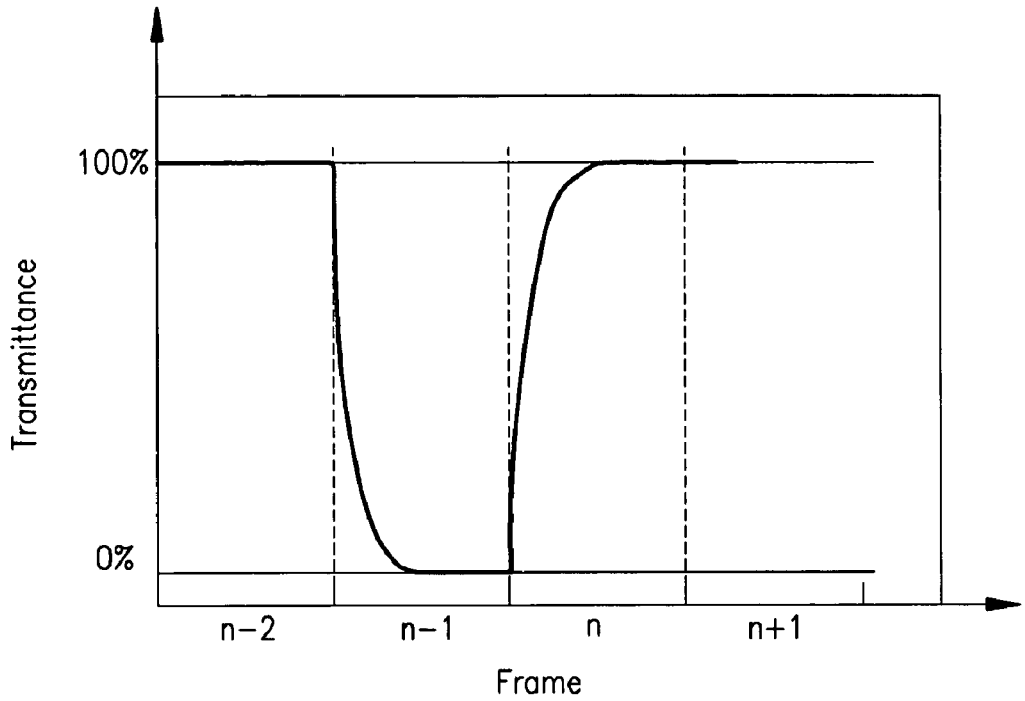
FIG. 13 is a graphical view showing transmittance at different frames shown in FIGS. 12A to 12C.

Referring to FIGS. 12A to 12C, provided are images at different frames displayed by the liquid crystal display device employing the signal compensate unit 61 shown in FIG. 6. FIG. 13 is a graphical view showing transmittance at different frames. In FIG. 13, the transmittance of each frame represents transmittance at the region with a "x" mark in the corresponding image. In this example, the test pattern is the same as the one in FIG. 8A and the test is performed in the same manner as done above with reference to FIGS. 8A to 8D. Then, the input signal becomes a 5-voltage signal at the (n−2)-th frame, an 1-voltage signal at the (n−1)-th frame, and a 5-voltage signal at the n-th frame.

Upon receiving the input signal, the signal compensate unit 61 (referring to FIG. 6) generates no pre-tilt voltage signal at the (n−1)-th frame. In this example, to generate the pre-tilt voltage signal at the (n−1)-th frame, an image signal at the (n−2)-th frame should be smaller than the third predetermined value Value3 or "2". Since the image signal at the (n−2)-th frame in this example is a 5-voltage signal that is larger than the third predetermined value Value3, the signal compensate unit generates the second compensate signal $C_{n,1}''$ substantially equal to the first compensate signal $C_{n,1}'$, which is an 1-voltage signal, instead of the pre-tilt voltage signal.

Referring to FIG. 13, the transmittance at the (n−1)-th frame is 0%, and the transmittance at the n-th frame is 100%. As a result, the region marked with "x" displays black at the (n−1)-th frame as shown in FIG. 12B, and displays white at the n-th frame as shown in FIG. 12C. In this example, the signal compensate unit generates the pre-tilt voltage signal as the compensate signal when the previous image signal is smaller than a predetermined value. As a consequence, the "x" marked region displays black instead of an image with a certain gray scale. By employing the signal compensate unit, the display device of the present invention improves the response rate of liquid crystal and image quality.

Having described the exemplary embodiments of the method of compensating image signals and the display device employing the same according to the present invention, modifications and variations can be readily made by those skilled in the art in light of the above teachings. It is therefore to be understood that, within the scope of the appended claims, the present invention can be practiced in a manner other than as specifically described herein.

What is claimed is:

1. A display device for displaying images, comprising:

a display panel having pixels;

a signal compensate unit that receives first, second and third image signals externally provided, and generates a first compensate signal obtained from the first and second image signals, the signal compensate unit generating a second compensate signal obtained from the first compensate signal and the first and third image signals; and a data driver that receives the second compensate signal from the signal compensate unit, the data driver generating data voltages corresponding to the second compensate signal to the pixels of the display panel.

2. The display device of claim 1, wherein the first, second and third image signals are image signals at three successive frames.

3. The display device of claim 1, wherein the signal compensate unit generates the second compensate signal having a first compensate value when the first image signal is smaller than a first predetermined value, the first compensate signal is smaller than a second predetermined value, and the third image signal is larger than a third predetermined value, wherein the first compensate value is a constant value.

4. The display device of claim 1, wherein the signal compensate unit generates the second compensate signal substantially equal to a summation of the first compensate signal and a second compensate value when the first image signal is smaller than a first predetermined value, the first compensate signal is smaller than a second predetermined value, and the third image signal is larger than a third predetermined value.

5. The display device of claim 4, wherein the second compensate value is obtained from the first image signal, the first compensate signal and the third image signal.

6. The display device of claim 5, wherein the second compensate value is a constant value.

7. The display device of claim 4, further including a data storage having compensate values each corresponding to a specific range of the first image signal, the first compensate signal, and the third image signal, wherein the second compensate value is selected from the compensate values of the data storage.

8. The display device of claim 3 or 4, wherein the signal compensate unit generates the second compensate signal substantially equal to the first compensate signal when the first image signal is equal to or larger than the first predetermined value.

9. The display device of claim 3 or 4, wherein the signal compensate unit generates the second compensate signal substantially equal to the first compensate signal when the first compensate signal is equal to or larger than the second predetermined value.

10. The display device of claim 3 or 4, wherein the signal compensate unit generates the second compensate signal substantially equal to the first compensate signal when the third image signal is equal to or smaller than the third predetermined value.

11. The display device of claim 1, wherein the signal compensate unit generates the first compensate signal that is equal to or larger than the second image signal when the first image signal is smaller than the second image signal.

12. The display device of claim 1, wherein the signal compensate unit generates the first compensate signal that is substantially equal to the second image signal when a difference between the first and second image signals is within a predetermined value.

13. The display device of claim 1, wherein the signal compensate unit includes:

a frame memory that receives and stores the first and second image signals;

a first compensator that receives the first and second image signals from the frame memory and generates the first compensate signal; and a second compensator that receives the first compensate signal from the first compensator, the first image signal from the from the frame memory, and the third image signal externally provided, the second compensator generating the second compensate signal.

14. The display device of claim 13, wherein the first compensator generates the first compensate signal that is equal to or larger than the second image signal when the first image signal is smaller than the second image signal.

15. The display device of claim 13, wherein the second compensator generates the second compensate signal having a first compensate value when the first image signal is smaller than a first predetermined value, the first compensate signal is smaller than a second predetermined value, and the third image signal is larger than a third predetermined value, wherein the first compensate value is a constant value.

16. The display device of claim 13, wherein the second compensator generates the second compensate signal substantially equal to a summation of the first compensate signal and a second compensate value when the first image signal is smaller than a first predetermined value, the first compensate signal is smaller than a second predetermined value, and the third image signal is larger than a third predetermined value.

17. The display device of claim 16, wherein the second compensate value is a constant value.

18. The display device of claim 16, further including a data storage having compensate values each corresponding to a specific range of the first image signal, the first compensate signal, and the third image signal, wherein the second compensate value is selected from the compensate values of the data storage.

19. The display device of claim 13, wherein the second compensator generates the second compensate signal substantially equal to the first compensate signal when the first image signal is equal to or larger than the first predetermined value.

20. The display device of claim 13, wherein the second compensator generates the second compensate signal substantially equal to the first compensate signal when the first compensate signal is equal to or larger than the second predetermined value.

21. The display device of claim 13, wherein the second compensator generates the second compensate signal substantially equal to the first compensate signal when the third image signal is equal to or smaller than the third predetermined value.

22. A method for compensating image signals in a display device, comprising:

recognizing first, second and third image signals at three successive frames;

obtaining a first compensate signal from the first and second image signals;

obtaining a second compensate signal from the first and third image signals and the first compensate signal; and providing the second compensate signal to pixels of a display panel.

23. The method of claim 22, wherein the step of obtaining the second compensate signal includes:

comparing the first image signal, the first compensate signal and the third image signal with first, second and third predetermined values, respectively; and determining the second compensate signal based on a result of the comparing.

24. The method of claim 23, wherein the step of determining the second compensate signal includes determining the second compensate signal to have a first compensate value when the first image signal is smaller than a first predetermined value, the first compensate signal is smaller than a second predetermined value, and the third image signal is larger than a third predetermined value, wherein the first compensate value is a constant value.

25. The method of claim 23, wherein the step of determining the second compensate signal includes determining the second compensate signal to be substantially equal to a summation of the first compensate signal and a second compensate value when the first image signal is smaller than a first predetermined value, the first compensate signal is smaller than a second predetermined value, and the third image signal is larger than a third predetermined value.

26. The method of claim 25, wherein the second compensate value is selected from compensate values each corresponding to a specific range of the first image signal, the first compensate signal, and the third image signal.

27. The method of claim 26, wherein the second compensate value is a constant value.

28. The method of claim 23, wherein the step of determining the second compensate signal includes determining the second compensate signal to be substantially equal to the first compensate signal when the first image signal is equal to or larger than the first predetermined value.

29. The method of claim 23, wherein the step of determining the second compensate signal includes determining the second compensate signal to be substantially equal to the first compensate signal when the first compensate signal is equal to or larger than the second predetermined value.

30. The method of claim 23, wherein the step of determining the second compensate signal includes determining the second compensate signal to be substantially equal to the first compensate signal when the third image signal is equal to or smaller than the third predetermined value.

31. The method of claim 22, wherein the step of obtaining the first compensate signal includes:

comparing the first image signal with the second image signal; and determining the first compensate signal to be equal to or larger than the second image signal when the first image signal is smaller than the second image signal.

* * * * *